United States Patent [19]

Bell

[11] Patent Number: 4,472,009

[45] **Date of Patent: * Sep. 18, 1984**

[54] SUPPLY CABINET PARTITION

[75] Inventor: Joseph M. Bell, Conway, Ark.

[73] Assignee: Tiffany Industries, Inc., St. Louis, Mo.

[ * ] Notice: The portion of the term of this patent subsequent to Apr. 20, 1999 has been disclaimed.

[21] Appl. No.: 369,621

[22] Filed: Apr. 19, 1982

Related U.S. Application Data

[63] Continuation of Ser. No. 177,780, Aug. 13, 1980.

[51] Int. Cl.[3] ..... A47B 27/00; A47B 83/04

[52] U.S. Cl. ..... 312/194; 312/107; 312/195; 220/22; 217/30

[58] Field of Search ..... 312/194, 195, 198, 107, 312/126, 111; 217/30, 33; 108/60; 220/22

[56] References Cited

U.S. PATENT DOCUMENTS

| | | | |
|---|---|---|---|
| 284,252 | 9/1883 | Smith | 217/33 |
| 1,526,095 | 2/1925 | Siegel | 312/194 |
| 1,656,644 | 1/1928 | Meisekothen | 217/33 |
| 2,424,080 | 7/1947 | Engstrom | 220/22 |
| 2,640,644 | 6/1953 | Hennessey et al. | 217/30 |
| 3,207,566 | 9/1965 | Grieco et al. | 220/22 |
| 3,365,259 | 1/1968 | Heisman et al. | 312/184 |
| 3,506,323 | 4/1970 | Leprince | 312/194 |
| 3,790,241 | 2/1974 | Messina | 312/195 |
| 4,164,312 | 8/1979 | Harned | 220/22 |
| 4,325,596 | 4/1982 | Bell | 312/194 |

FOREIGN PATENT DOCUMENTS

| | | | |
|---|---|---|---|
| 209022 | 5/1960 | Fed. Rep. of Germany | 312/194 |
| 252106 | 12/1947 | Switzerland | 312/195 |
| 929683 | 6/1963 | United Kingdom | 312/195 |

*Primary Examiner*—Victor N. Sakran

*Attorney, Agent, or Firm*—Cohn, Powell & Hind

[57] ABSTRACT

This cabinet and partition assembly can be used with office stands of the type having a table top, and the assembly includes a cabinet attached to the underside of the table top and having opposed side panels and a lower panel of substantially the same interior size as each other to define a square front access opening. The partition includes opposed parallel side members having perpendicular members extending therebetween, said partition having the same overall perpendicular dimensions. The partition dimensions define a square of substantially the same size as the cabinet access openings so that the opening can receive the partition in a horizontal shelf mode, or, when turned through ninety degrees, can receive the partition in a vertical divider moder. The cabinet is provided with a door which may be optionally hung on either of the cabinet side panels.

4 Claims, 6 Drawing Figures

SUPPLY CABINET PARTITION

This is a continuation of Ser. No. 177,780, filed Aug. 13, 1980.

BACKGROUND OF THE INVENTION

This invention relates generally to storage cabinets and in particular to a storage cabinet and partition assembly which provides horizontal or vertical storage spaces as required.

Storage cabinets of the type under discussion, when they are provided with shelves, are most frequently provided with built in horizontal shelves. When the cabinet is desired for use as a storage cabinet for binders and other items which are preferably stored in an upright position, either the shelves must be somehow adapted to store the items in question. Of course it is possible to provide cabinets with vertical dividers, and this is sometimes done. However, in the event that horizontal shelving is desired by a particular user for storing materials such as typing paper or similar material, which is better stored in a flat, horizontal position, the problem is again presented. Attempts have been made to overcome the problem by providing larger cabinets with both horizontal and vertical storage pockets. This presents the obvious disadvantage that such cabinets tend to be larger than really necessary and while some users may use both types of pockets there is a tendency for only one type to be used in its intended manner.

The present invention overcomes these and other problems in a manner not disclosed in the known cited art.

SUMMARY OF THE INVENTION

This cabinet and partition assembly provides a removable partition which is adapted for insertion in the cabinet to provide either horizontal shelves or vertical dividers as desired.

The cabinet includes a pair of vertical side panels disposed in spaced parallel relation, a lower panel extending between said side panels, a rear closure panel extending between said side panels, said side panels and said lower panel defining a front end access opening. The partition includes opposed side members at least one perpendicular member extending between said side members, the overall height of said side members and the overall width of said side members defining a square having a side dimension substantially equal to the width of the access opening, the access opening receiving said partition in a shelf mode in which the opposed side members are parallel to the opposed cabinet side panels and also receiving said partition in a divider mode in which the opposed side members are parallel to said upper and lower panels.

In one aspect of the invention the cabinet includes a swing door having a vertical hinger axis and each side wall of the cabinet includes means for mounting the door to provide a right or left hand door mounting capability.

In another aspect of the invention the partition includes a flat plate providing one of the side member; a bent plate having parallel legs, one leg being attached to the flat plate and the other leg providing at least part of the other of said side members and a connecting leg providing said one perpendicular member.

In another aspect of the invention the partition includes a bent plate having parallel legs of unequal length, the shorter leg being attached to the flat plate and the longer leg providing at least a part of the other of said side members, and a connecting leg providing said perpendicular member.

In yet another aspect of the invention the partition includes a plurality of perpendicular members extending between said side members.

In another aspect of the invention the partition includes a first bent plate having parallel legs, one leg being attached to the flat plate and the other leg providing at least a part of the other of said side members and a connecting leg providing one of said perpendicular legs; and a second bent plate having parallel legs, one leg being attached to the flat plate and the other leg providing at least part of the other of said side members, and a connecting leg providing another of said perpendicular legs.

In still another aspect of the invention the first bent plate is substantially Z-shaped, having a short leg attached to said flat plate and a long leg providing at least part of the other of said side members; and the second plate is substantially U-shaped having one leg attached to the flat plate and the other leg providing at least part of the other of said side members.

In another aspect of the invention the first bent plate long leg is substantially two thirds the length of the first plate.

In yet another aspect of the invention the second bent plate legs are substantially one third of the length of the flat plate.

In still another aspect of the invention the cabinet and partition assembly are mounted to a table which includes an elongate top having opposed ends, an elongate shelf disposed in spaced parallel relation below the top and having opposed ends, and a pair of opposed legs connecting the top and the shelf at each end thereof. The cabinet is mounted to the table top so that said top, at least in part, defines an upper panel of the cabinet.

DESCRIPTION OF THE PREFERRED EMBODIMENT

Figure 1:
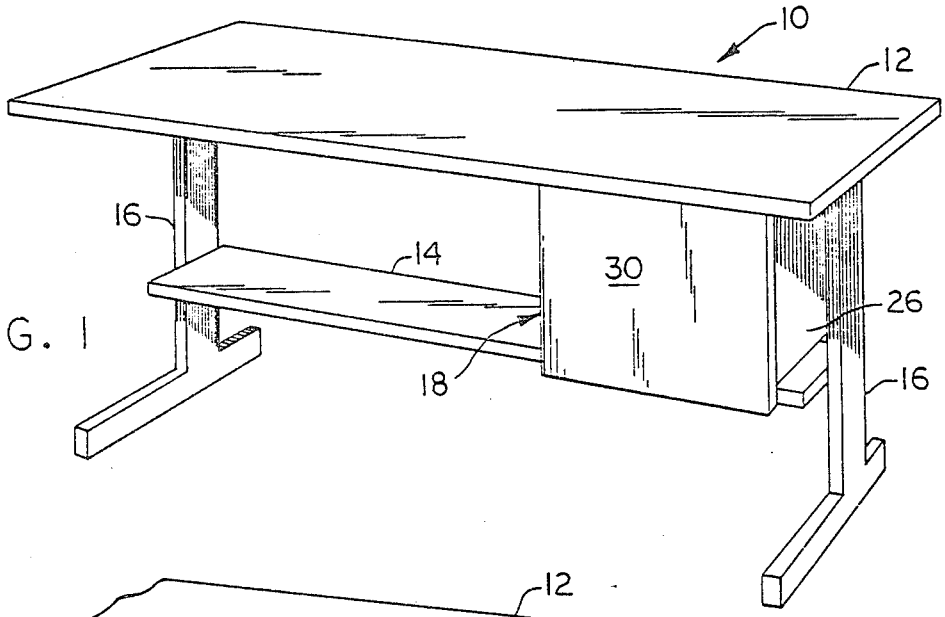
FIG. 1 is a perspective view of a table having an underslung cabinet.

Referring now by characters of reference to the drawings and first to FIG. 1 it will be understood that the cabinet and partition assembly can form part of a table, such as is commonly used for a business machine stand, generally indicated by numeral 10. The table 10 includes an elongate table top 12, and a substantially parallel elongate shelf 14 both of which are interconnected at their ends by inverted T-shaped legs 16. The cabinet 18 in the preferred embodiment is disposed between said table top 12 and shelf 14 and, in the preferred embodiment, is physically attached to the table top 12 but spaced from the shelf 14 as clearly shown in FIGS. 3 and 4.

In the embodiment shown the cabinet 18 includes an upper panel 20, which is formed from a portion of the table top 12; a lower panel 22 disposed in spaced relation from said upper panel and opposed vertical side panels 24 and 26 disposed in spaced parallel relation and extending between said upper and lower panels. The side panels 24 and 26 each includes an upper elongate lip 23 apertured lengthwise to receive fasteners (not shown) which attach the cabinet 18 to the table top 12. The lips 23 are connected at their front end by a transverse bar 25, as by welding, said bar tending to stiffen the cabinet 18, which in the embodiment shown is of sheet metal construction, during installation and shipping. A rear closure panel 28 is provided which in the preferred embodiment extends between the upper and lower panels and the opposed side panels. By this structural arrangement of parts the upper and lower panels, the side panels and the end panels cooperate to define a front open box having a substantially square access opening. The access opening is provided with a door panel 30 having a piano-type hinge 32 fixedly attached thereto along one edge and having a spring-loaded, ball-type friction catch 34 adjacent the opposite edge. The opposed panels 24 and 26 each includes a vertical post member 27 having a plurality of threaded inserts 29 which are adapted to receive hinge bolts 31. Panels 24 and 26 also include slightly elongated ball-receiving openings 36 which are adapted to cooperate with the friction catch 34 and, in the preferred embodiment, the catch 34, the opening 29 and the hinge fastener inserts 29 are generally symmetrically disposed to provide said panel with a right or left hand door mounting capability. A resilient bumper strip 38 is provided on the door post member 27 adjacent the catch 34.

Figure 2:
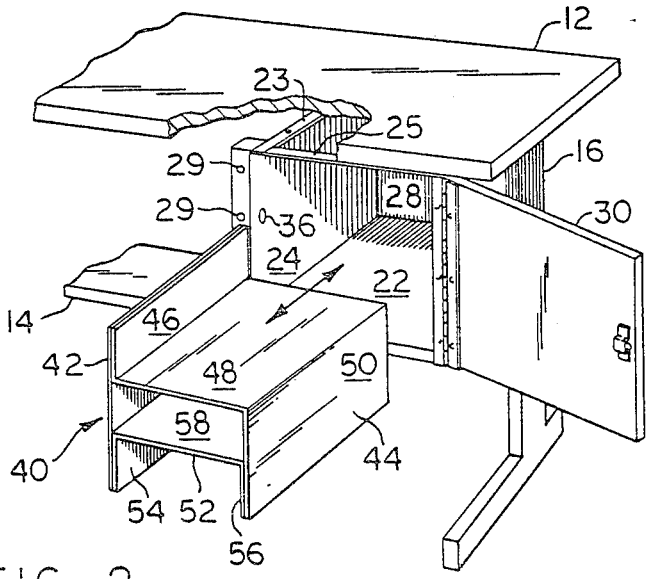
FIG. 2 is a fragmentary view of the stand with the cabinet door open and the partition removed.
Figure 6:
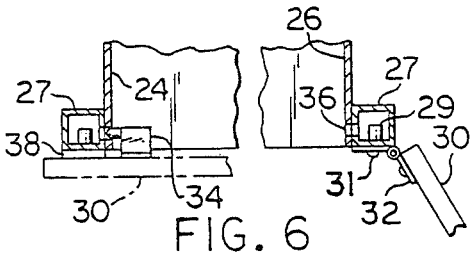
FIG. 6 is a fragmentary view of the door mounting.

The partition 40, which in the preferred embodiment is also of sheet metal construction, is best shown in FIG. 2. As shown, the partition 40 consists essentially of a flat plate 42; a first Z-shaped bent plate 44, having a relatively short leg 46 an intermediate leg 48 providing a transverse connecting member and a relatively long leg 50; and a second U-shaped bent plate 52, having opposed side legs 54 and 56 and an intermediate leg 58 providing a transverse connecting member. In the preferred embodiment, the short leg 46 of the Z-shaped plate 44 is approximately one-third of the height of the first plate 42 and is attached thereto as by welding. The arms 54 and 56 of the U-shaped plate 52 are also one-third of the height of the plate 42 and are attached to said plate 42 and to said long leg 50 of the Z-shaped plate 44 as by welding.

Figure 5:
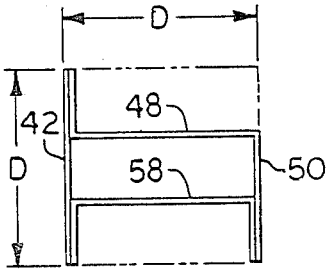
FIG. 5 is a front end view of the partition illustrating the relative proportions thereof.
Figure 3:
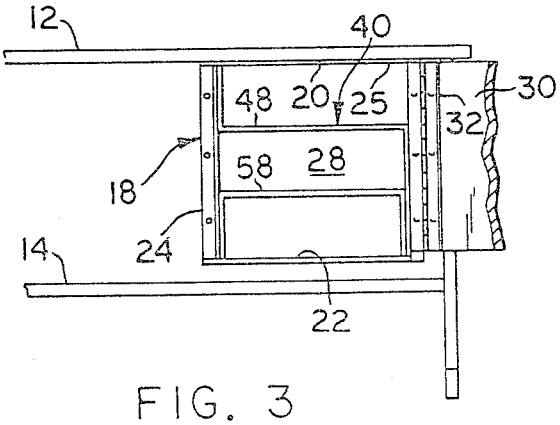
FIG. 3 is a fragmentary front elevational view illustrating the cabinet and partition assembly with the partition in a shelf mode.
Figure 4:
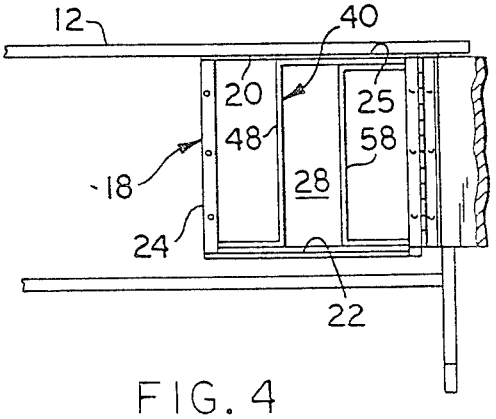
FIG. 4 is a similar view with the partition in a divider mode.

As will be readily understood by reference to FIG. 5 the overall height of the plate 42 and the overall width of the members 42 and 50 define a square of substantially the same size as the access opening and having a side of dimension D, which is slightly less than the distance between the cabinet side panels 24 and 26. The plate 42, reinforced by legs 46 and 54 of members 44 and 52 respectively; and the leg 50 of member 44, reinforced by leg 56 of member 52, constitute opposed side members. The intermediate legs 48 and 58 of bent plates 44 and 52 respectively, as shown in FIGS. 2, 3 and 5, provide horizontal shelves such that when the partition 40 is inserted within the cabinet 18 three substantially equal horizontally elongate pockets are formed. When the partition 40 is withdrawn, rotated through ninety degrees about the withdrawal axis, legs 48 and 58 provide vertical dividers such that when the partition 40 is re-inserted within the cabinet 18 three substantially equal vertically elongate pockets are formed. Thus, the cabinet and partition assembly can be readily transformed from a shelf mode into a divider mode. In the divider mode, as will be understood from FIG. 4, the "height" of the partition becomes the "width" and the partition 40 is snugly received within the cabinet 18 because these dimensions are equal.

It will also be understood that the depth of the partition 40, measured axially in the direction shown by the double direction arrow in FIG. 2 indicating insertion and withdrawal, is somewhat less than the depth of the cabinet so that the front end of the partition is slightly recessed relative to the front end margins of the cabinet 18 to permit the door 30 to be easily closed.

It is thought that the structural features and functional advantages of this cabinet and partition assembly have become fully apparent from the foregoing description of parts but for completeness of disclosure the installation as a whole will be briefly described.

The cabinet 18 in the preferred embodiment is attached only to the underside of the table top 12. Thus, once the tabletop 12, the shelf 14 and the legs 16 are connected it becomes a simple matter to remove the partition 40 from the preassembled cabinet 18 in which it is shipped and attach said cabinet to either the right or left hand side of the table 10 as desired. If the door panel 30 which in the preferred embodiment is of wood, particle board, or the like, is mounted to the right post member 27 and it is desired to mount it to the left post member 27, it is simply a matter of removing the hinge fastener bolts 31, reversing the door panel top-to-bottom and attaching the hinge to the left post member.

The manufacture of the cabinet 18 to provide an access opening twelve inches square produces three shelf pockets, as shown in FIG. 3, approximately twelve inches long and four inches in height. This size pocket is very convenient for storing regular typing paper and similarly sized materials flat. When, on the other hand, it is desired to utilize the cabinet 18 primarily for the storing of books, binders and the like which are preferably stored in an upright position, it is a simple matter to remove the partition 40, rotate it through ninety degrees and re-insert it, thereby providing three vertical pockets approximately four inches wide by twelve inches in height.

I claim as my invention:

1. A cabinet and partition assembly comprising:

(a) a cabinet including:

1. a pair of substantially vertical side panels disposed in spaced parallel relation,
2. a lower panel extending between said side panels,
3. a rear closure panel, and
4. said side panels and said lower panels defining a front end access opening, (b) a removable partition including:

1. opposed side members,
2. at least one perpendicular member extending substantially uninterruptedly between said side members, and
3. the overall width of said side members being substantially the same as the width of the access opening, said access opening optionally receiving said partition in a front access shelf mode in which the opposed side members are parallel to said opposed cabinet side panels and the perpendicular member provides an intermediate shelf and also receiving said partition in a front access divider mode in which the opposed side members are perpendicular to said side panels and the perpendicular member provides an intermediate divider, when the partition is withdrawn, rotated through ninety degrees (90°) and re-inserted within the cabinet.

2. An assembly as defined in claim 1, in which:

(c) the partition includes a plurality of perpendicular members extending substantially uninterruptedly between said side members.

3. An assembly as defined in claim 1, in which:

(c) at least one of said side members has a height substantially two-thirds the width of the access opening.

4. An assembly as defined in claim 1, in which:

(c) the access opening is substantially square.

* * * * *